United States Patent [19]

Gregory et al.

[11] Patent Number: 5,042,107

[45] Date of Patent: Aug. 27, 1991

[54] TOOTHBRUSH BRISTLE CLAMP

[75] Inventors: Harbert S. Gregory, 26 Country Club Park, Covington, La. 70433; Sheldon P. Schmidt, Paramus, N.J.

[73] Assignee: Harbert S. Gregory, Covington, La.

[21] Appl. No.: 432,147

[22] Filed: Nov. 6, 1989

Related U.S. Application Data

[63] Continuation-in-part of Ser. No. 199,373, May 27, 1988, Pat. No. 4,884,311.

[51] Int. Cl.[5] ..... A46B 17/04

[52] U.S. Cl. ..... 15/257 R; 15/167.1; 15/184; 15/246; 24/20 R; 206/362.3

[58] Field of Search ..... 15/167.1, 168, 184, 15/246, 257 R; 24/20 R, 20 X, 205, 136 R; 206/361, 362.2, 362.3 X; 269/234, 254 R

[56] References Cited

U.S. PATENT DOCUMENTS

| | | | |
|---|---|---|---|
| 1,365,411 | 1/1921 | Kearney | 24/136 R |
| 2,220,203 | 11/1940 | Branin | 24/136 R |
| 2,797,886 | 7/1957 | Pinckney | 15/184 |
| 2,897,531 | 8/1959 | Calabrese | 15/257 R |
| 2,947,412 | 8/1960 | Tupper | 15/184 |
| 4,858,810 | 8/1989 | Intlekofer et al. | 24/136 R |

FOREIGN PATENT DOCUMENTS

| | | | |
|---|---|---|---|
| 241090 | 5/1911 | Fed. Rep. of Germany | 15/184 |
| 915175 | 7/1946 | France | 15/246 |

*Primary Examiner*—Philip R. Coe
*Assistant Examiner*—Mark Spisich
*Attorney, Agent, or Firm*—Jennings, Carter, Thompson & Veal

[57] ABSTRACT

A toothbrush holder for training the bristles of a toothbrush into a preferred shape utilizes a pair of opposed cam surfaces to urge a pair of rigid compression members against the sides of the mass of bristles along a line at a predetermined height on the bristles. The resultant bristle structure is maintained by repeated storage of the brush in the holder between use.

3 Claims, 9 Drawing Sheets

FIG. 1
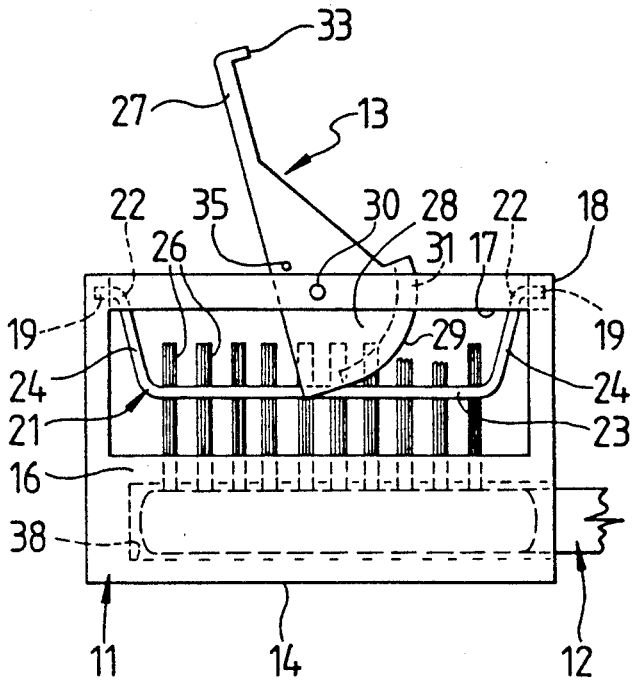
FIG. 2
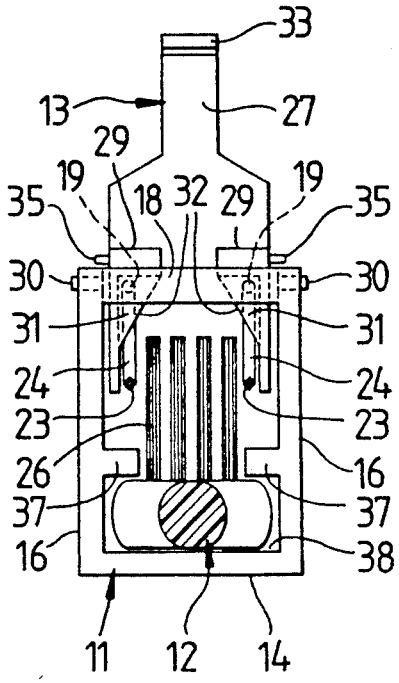
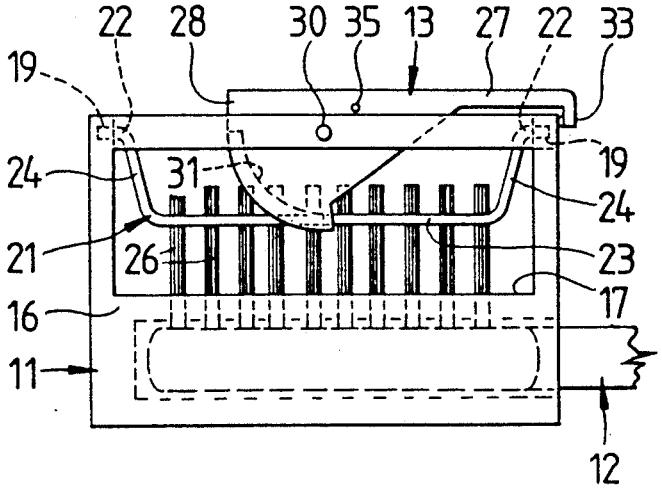
FIG. 3
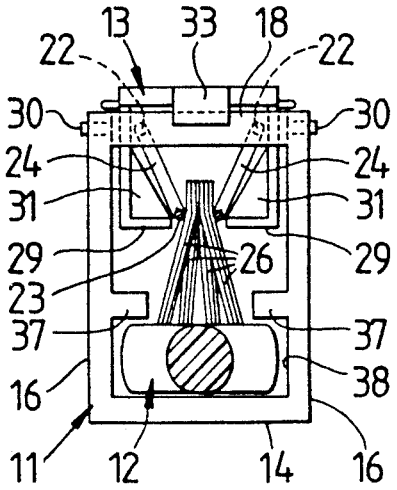
FIG. 4

FIG. 5
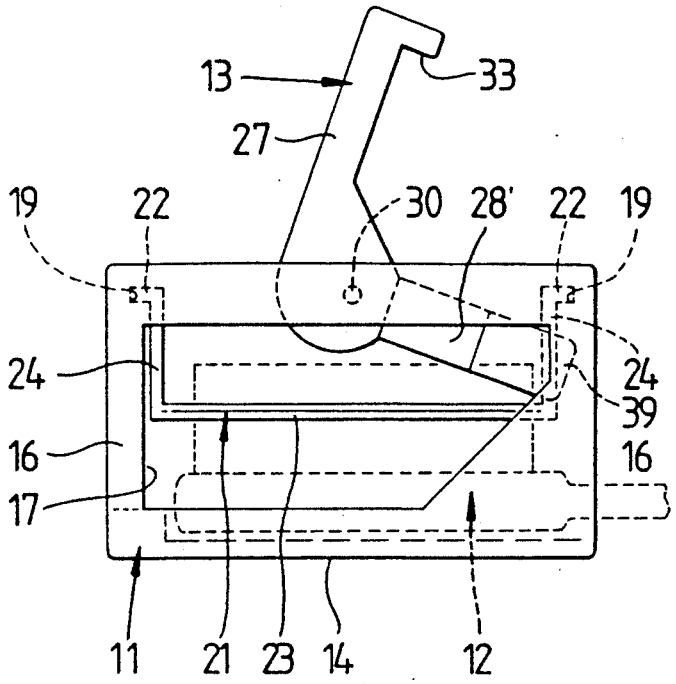
FIG. 6
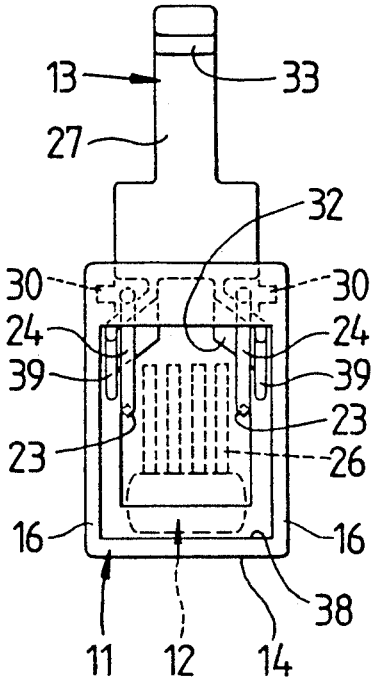
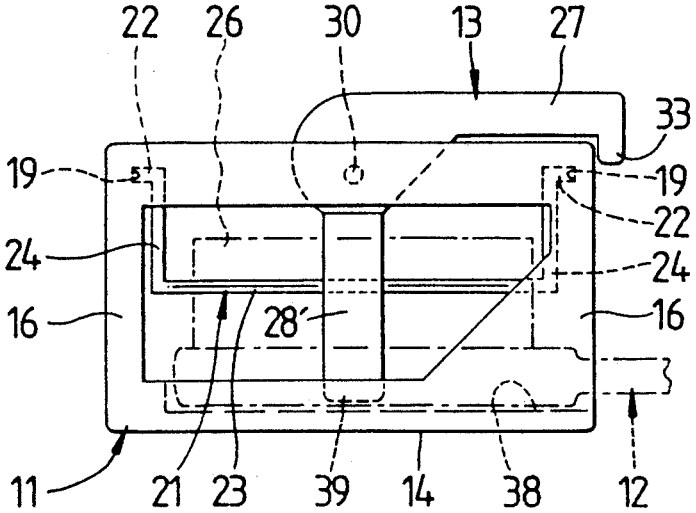
FIG. 7
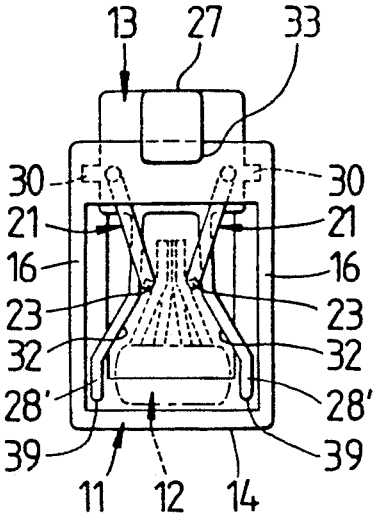
FIG. 8

FIG. 15
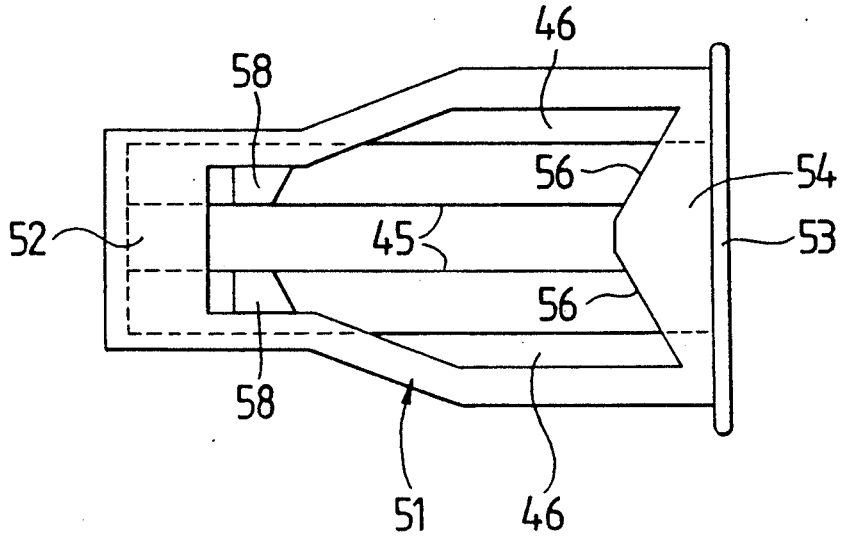
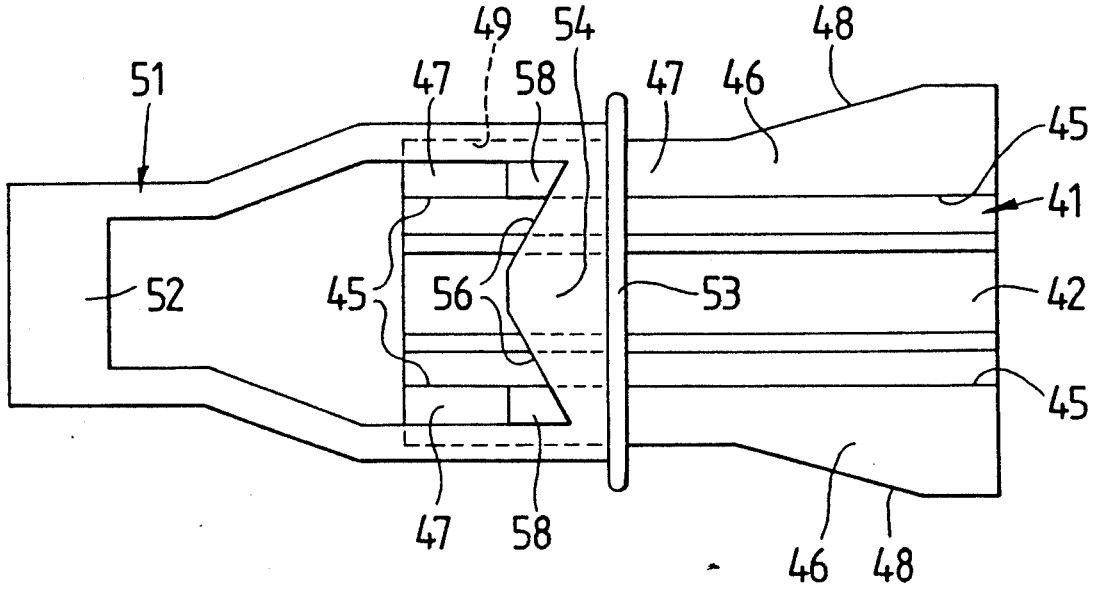
FIG. 16

BRUSH IN CLAMP

BEFORE BRUSHING

AFTER BRUSHING

AFTER COUPLE WEEKS USE

BRUSH IN CLAMP

BEFORE BRUSHING

AFTER BRUSHING

FINAL SHAPE

BRUSH IN CLAMP

BEFORE BRUSHING

AFTER BRUSHING

EDGE BRUSHING
BRUSH IN VERTICAL ORIENTATION

FLARE BRUSHING
BRUSH IN HORIZONTAL ORIENTATION

TOOTHBRUSH BRISTLE CLAMP

This is a continuation-in-part of application Ser. No. 07/199,373, filed May 27, 1988, Pat. No. 4,884,311.

BACKGROUND OF THE INVENTION

In the field of dental hygiene, it is known that it is advantageous to use a soft-bristle toothbrush for regular home-cleaning regimens. This is particularly true, from the specialized view of the field of periodontistry. That area of dentistry is principally concerned with the physiology and pathology of the gums and other "soft-tissue" of the tooth-bearing region of the mouth, vis-a-vis the teeth themselves and their associated skeletal regions. More particularly, periodontistry is directed toward preventing and correcting the diverse effects of plaque-causing bacteria in the gingival sulcus area under the gum flap which covers the base of the teeth.

In the daily home-practice of oral hygiene, periodontists strongly favor the use of toothbrushes having soft bristles. The reasons for this are to provide a brush which is sufficiently flexible to massage thoroughly the soft tissues of the mouth, to stimulate blood circulation, and to disorganize bacteria; all without causing undue trauma to the oral tissues. Further, the straight bristles normally used in a conventional brush, are not effective to scour comfortably under the gum flap.

Currently, the bristles in toothbrushes are almost always made from thermo-plastic materials. Inherently, these are easily deformed. Soft bristles, being inherently even more supple and susceptible to bending than "hard" bristles which are thicker and/or made from material which is more rigid structurally, are not useful for any reasonable period of time in the manner which periodontists particularly seek. Such bristles individually spread and bend over and become fixed more or less permanently in a multitude of directions, rather than staying aligned, more or less. Thus, the bristles do not present a coordinated mass of soft bristles to the brushed area. This can render the brush unusable, particularly over any considerable length of time, and even hazardous to the soft tissues in the mouth.

The long, soft, bristles in the presently available designs are, inherently, individually, structurally weak, and readily collapse under pressure. For this reason, brushes are made available in the "medium" and "hard" bristle types so they will stand up better under the pressure of brushing. Yet these are counter-productive because the stiffer bristles have a greater tendency to injure the soft tissues. This tendency to injury increases as the bristles spread with use.

From the foregoing, it may be seen that:

All present brushes become permanently deformed with use and increasingly become unsatisfactory for use.

The basic shape of the present bristle design does not lend itself to reaching the vital sulcus area under the gum flaps.

The soft bristles rapidly become deformed with repeated use and do not present a resilient coordinated mass of soft bristles for brushing action.

The "medium" and "hard" brushes provide increased resilience, when new, but soon take a self-defeating spreading set.

Further, it is the natural characteristic of wet thermoplastic and other types of bristles to take a permanent "set" when repeatedly forced into disarray by the brushing action. As is well known, this disarray becomes a permanent shape of the brush, and thereby renders it hazardous to use. However, this characteristic of taking a "set" while wet can be controlled, and the resulting, permanent shape can be trained into an improved and highly advantageous arrangement by the use of a training clamp.

Further, because the bristles are soft, they will be bent into undesirable disarray if they are forced into a permanently arranged spring clamp. The clamp must be removably affixed so that it may be repeatedly applied and re-applied without disturbing the bristles into a non-perpendicular disarray and causing them to take the wrong "set".

All of the above establishes a need to form the bristles of a soft bristle toothbrush in a manner to substantially increase the effective resilience of the soft bristles, to eliminate the need for the "medium" and "hard" brushes; and to at the same time, produce a maintainable, coordinated mass of soft bristles, so formed that the sulcus area is properly addressed, and all surfaces are comfortably and effectively scoured.

A variety of proposals have been made for straightening brush bristles after use. Some of them contemplate pressing to a limited degree on the free ends of the outer bristles so as to cause them to deflect inwards, so as to make the group of bristles form a uniform mass without edge fraying. In this connection, reference is made U.S. Pat. Nos. 271,814; No. 637,522; No. 1,444,677; No. 3,120,019; and No. 3,995,743. However, even these prior art teachings do not produce results desired by periodontists and other such specialists in oral hygiene since, even when practiced with soft bristle brushes, the effect at best is merely to reduce edge-fraying. Consequently, the prior art devices provide no greater remedial effect than is available in any soft toothbrush, even when brand new and unfrayed.

Accordingly, it is the object of this invention to provide a means whereby the natural weakness of the wet, soft, bristles to splay out with use can be controlled, and the wet bristles trained to deform in an advantageous shape. The repeated act of clamping the wet brush tightly in the approximate 70% of length area while it is not in use, together with the splaying effect of the brushing action, gradually produces a brushing "flare" of soft bristles, supported by a structural wedge of soft bristles. The wet condition, the tight clamping and the bending effect of the brushing action are all three essential to the forming of the structurally supported flare.

Accordingly, it is an object of this invention to provide a means for forming soft bristles into close juxtaposition in a unique, crucial region proximal their free ends with the free ends of said bristles flared outward with respect to the region in which they are closely juxtaposed.

Still another object of this invention is to enhance the resiliency of the tooth-contacting portion of the bristles by shape and juxtaposition.

Another object is to provide a means for compressing a toothbrush such that the bristles are bent at a crucial point, and the ends are trained into a coordinated flare of soft bristles by the repeated action of brushing and clamping when wet.

Still another object of this invention is to provide a means to attain a thin resilient edge of soft bristles along the edge of the flare. Brushing with the flare against its new, assumed shape, provides a soft, resilient, thin mass of bristles that comfortably scours beneath the gum flaps. This "brushing edge" is a new concept and provides advantages not otherwise attainable.

Another object of this invention is to provide a means to reform the bristles of a toothbrush after each use into a unique coordinated mass of soft bristles.

Another object of this invention is to form the bristles of the toothbrush such that the free ends of said bristles above a crucial pressure area will be flared outward, by repeated brushing action, with respect to the lower region in which they are closely juxtaposed.

Another object of the invention is to provide a means for forming the bristles of a toothbrush in which the lower portion of bristles below a crucial bending and pressure area are formed into a wedge-like shape which converges at the pressure point.

Another object of this invention is to identify the location of the crucial pressure area in relation to the length of the bristles, above which point the flare and supporting wedge are not formed, and below which crucial area the application of a line of compression causes the bent bristles to splay outward instead of bending inward on themselves.

Another object of the invention is to establish the bristles of a dental appliance into a shape that effectively eliminates the need for a "medium" or "hard" brush.

Still another object of this invention is to provide such apparatus in a form which is removably affixable after each use.

Another object is to apply all of the above to the training of any soft bristle brush whereby an upper, flared, coordinated mass of brush ends is supported by a trained, wedge-like, formation of the coordinated lower mass of bristles so that brushing pressure causes the lower portion of the bristles to bend inward towards each other to gain increased resilient support, rather than to splay outward in individual weakness as in present cases.

SUMMARY OF THE INVENTION

The desired objects may be achieved using my invention which comprises a removable receptacle for the insertion of an ordinary soft bristle toothbrush with the receptacle having a compression means extending longitudinally thereof such that the bristles of the brush are received therebetween without distorting their vertical parallel relationship. A camming action urges the compression members inwardly against the bristles at a preselected height such that the lower portion of the bristles are formed into a wedge-shaped mass, while the bristle ends remain free to flare outwardly above the compression members.

BRIEF DESCRIPTION OF THE DRAWINGS

Apparatus embodying features of my invention are depicted in the accompanying drawings, which form a portion of this disclosure and wherein:

FIG. 1 is a side elevational view showing the closure members in an open position;

FIG. 2 is an end view of the apparatus of FIG. 1 with a toothbrush inserted;

FIG. 3 is a side elevational view of the apparatus closed;

FIG. 4 is an end view of the apparatus as in FIG. 3 with a toothbrush inserted;

FIG. 5 is side elevational view of a second embodiment of the invention;

FIG. 6 is an end elevational view of a second embodiment of the invention;

FIG. 7 is a side elevational view of the second embodiment of the invention in the clamped position;

FIG. 8 is an end view of the second embodiment of the invention in a bristle clamped position;

FIG. 15 is a plan view of a third embodiment of the invention in a clasped position;

FIG. 16 is a plan view of a third embodiment of the invention in an open position;

DESCRIPTION OF A PREFERRED EMBODIMENT

Figure 9:
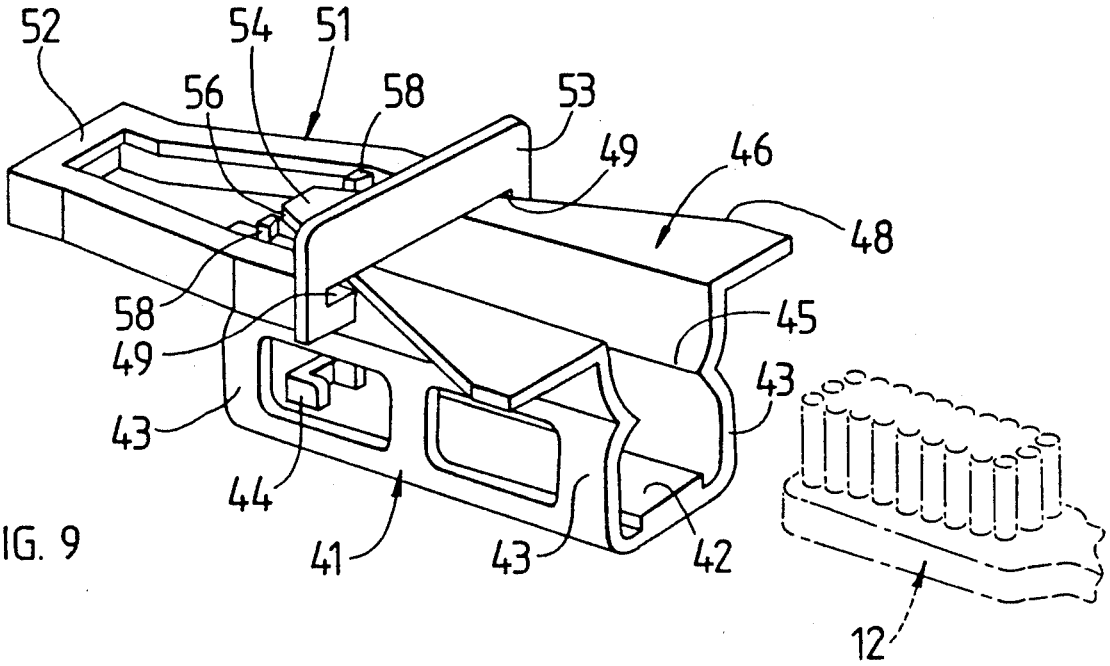
FIG. 9 is an isometric view of a third embodiment of the invention while in an open position.

Referring to the drawings for a clearer understanding of the invention and further referring to my co-pending U.S. Pat. application Ser. No. 199,373 which is hereby incorporated by reference, it may be seen that I have provided in the instant apparatus a device which is useful with a wider range of brush sizes to achieve the result of proper brush formation and maintenance.

As may be seen in FIGS. 1 & 2, my apparatus includes a lower portion 11 which serves as a receptacle for a toothbrush 12 and a movable portion 13 pivotally mounted to the receptacle 11 at the top thereof. The receptacle, which is preferentially made from a strong molded plastic, has a bottom 14 and a pair of spaced apart sidewalls 16. The sidewalls may be windowed as at 17 on their upper portion or may be solid. One end of the receptacle 11 is open to permit insertion of the toothbrush 12 and the other end is preferentially partially closed. The open end or ends of the receptacle are spanned by a brace 18 connected at each end to the tops of sidewall 16. Each brace has a pair of recesses 19 therein spaced inwardly from said sidewalls 16. An elongated rigid compression member 21, such as a suitably stiff wire or molded plastic, has each end thereof inserted into one of the recesses 19 such that a pair of compression members 21 are permitted to swing free, but are pivotally supported in longitudinal alignment within the receptacle 11. The compression members 21 each include rounded end portions 22 for insertion into the recesses 19 and a central portion 23 extending substantially the length of the interior of the receptacle 11 with the central portion 23 connected to the end portions 22 by an angled portion 24 such that rotation of the compression members about the axis of the end portion 22 moves the central portion 23 through an arc about the axis. Thus the central portion 23 of the compression members 21 are parallel to each other and are suspended on either side of the bristles 26 of toothbrush 12 when properly inserted into the receptacle 11. The height of the central portion 23 is important in proper bristle formation, therefore the compression members 21 may be formed for proper use with a brush of commensurate bristle length, i.e. short, medium or long.

Movable portion 13 controls the spacing between the central portion 23 of the compression member 21, and includes a handle portion 27 and a jaw portion 28. The jaw portion 28 has a pair of spaced apart jaw members 29 which are semi-circular in shape and extend radially from the axis of rotation 30 of the movable portion 13 and between the adjacent sidewall 16 and compression member 21. Each jaw member has formed on the circumference thereof a wedge-like cam 31 which extends laterally toward the center of the receptacle 11 forming a ramp-like surface 32 which abuts the central portion 23 of the adjacent compression member 21. The handle portion 27 is rigidly attached to the jaw portion 28 for concomitant rotation about the axis of rotation 30. A tab member 33 is formed on the end of handle 27 and positioned to engage the brace 18 to releasably lock the movable portion thereto.

In operation, the handle portion is moved to a fully open position, whereat an interface knob 35 abuts the top of the sidewall 16. In this position the compression members 21 abut the ramp surfaces 32 at the widest separation therebetween. A toothbrush 12 is then inserted into the receptacle 11 with the bristles centered between the free swinging compression members and at a relative height thereto to facilitate proper wedge formation. It may be desirable to form a pair of stops 37 on the inner surfaces of sidewalls 16 to provide a chamber for the brush handle and a guide slot 38 for the bristles to insure proper placement of the bristles relative to the compression members 21. With the brush 12 properly positioned, the handle 27 is moved to the closed position, thereby causing the ramp surfaces 32 to engage the closure members 21 in even narrower separation, which in turn clamps the bristles of the brush between the central portion 23 along a line defined thereby such that the portion of the bristles below the line form a coherent wedge shape and the bristle portion above the line is flared outwardly from the line of applied pressure. The tab member 33 contacts the edge of brace 18 in a close fitting manner to releasably lock the handle 27 to the brace 18.

A second embodiment of the invention is shown in FIGS. 5–8 wherein the lower portion 11 is the same as shown in the preceding FIGS. However the stops 37 have been removed from the inner surfaces of the sidewalls 16. In this embodiment the movable portion 13 is modified, in that the jaw 28 is no longer an arcuate member but rather extends at approximately 90 degrees from the handle member 27 which remains unchanged. As may be seen most clearly in FIGS. 7 and 9, the modified jaw member 28' is integrally formed with the handle member and is spaced apart at the junction with the handle member to form a narrow channel for receiving the bristles 26 therein. The modified jaw 28' then flares outwardly distal the handle member, uniformly to each side, and terminates in a portion 39 which is substantially parallel to the inner surfaces of the sidewalls 16 and slidingly abuts the sidewalls 16. The terminal portion 39 is sufficiently wide to receive the handle portion of the toothbrush as shown in FIG. 8. The pivotally mounted compression members 21 are positioned with their central portions 23 inwardly of the end portions 39 of the modified jaw member 28'. Thus, as the jaw member is rotated from a position perpendicular to the bristles as shown in FIG. 5 to a position parallel to the orientation of the bristles as shown in FIGS. 7 and 8, the ever-narrowing taper of the jaw member 28' forces the compression members 21 inwardly against the bristles resulting in the deformation of the bristles as shown in FIG. 8 which corresponds to the deformation of the preceding embodiment as shown in FIG. 4.

A third embodiment of the invention (somewhat modified from the previous embodiments) is shown in FIGS. 9–16. A sliding bottom receptacle 41 contains a raised base 42 which extends the length of the bottom 41 and a pair of sidewalls 43 windowed to create greater flexibility. An endstop 44 is located on the raised base 42 opposite the open end of the receptacle 41 to insure proper placement of the bristles relative to the receptacle 11. As the sidewalls 43 extend upward, they curve inwardly and then outwardly in relation to the longitudinal axis of the receptacle 41, thereby forming a clasping edge 45 (see FIG. 14), which extends the longitudinal distance of the sidewalls 41.

A pair of clasping wings 46 extend forwardly and outwardly from the outside surface of each sidewall 43, being integrally attached and extending from the upper edge of the sidewall 43. The clasping wings 46 form a planar surface perpendicularly extending from the sidewall 16. Each of the wings 46 includes a generally rectangular forward portion 47 and an outwardly flaring rear portion 48 with the marginal edges of the clasping wings defining cam surfaces which engage the inner surfaces of a pair of compression tracks 49 included within a compression housing 51.

Figure 10:
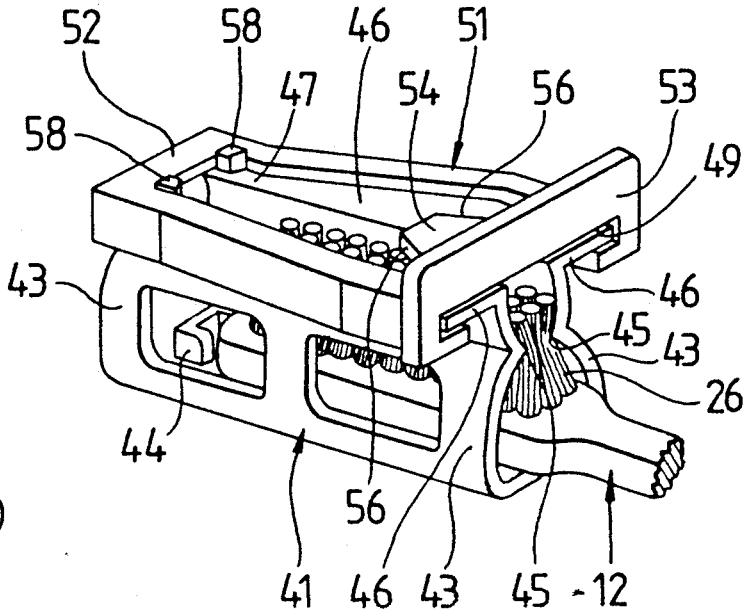
FIG. 10 is an isometric view of a third embodiment of the invention while in a clasped position.
Figure 11:
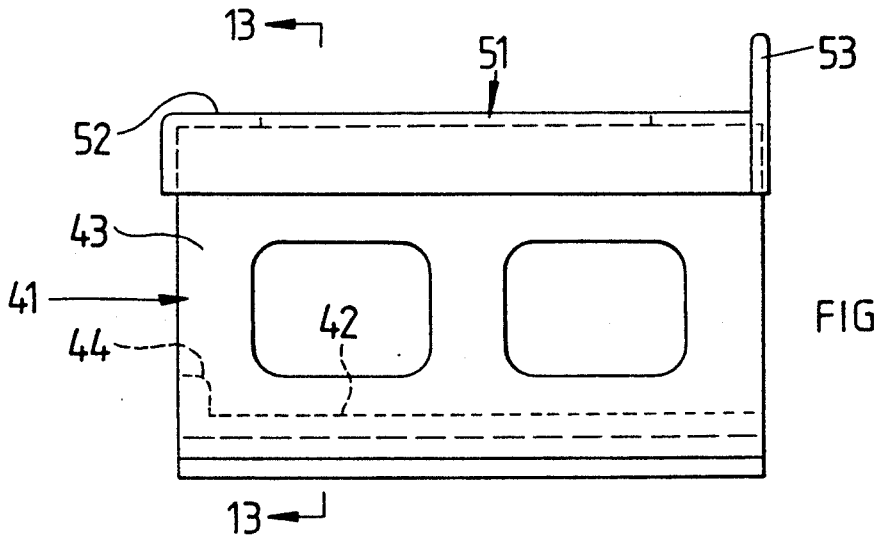
FIG. 11 is a side view of a third embodiment of the invention while in a clasped position.
Figure 12:
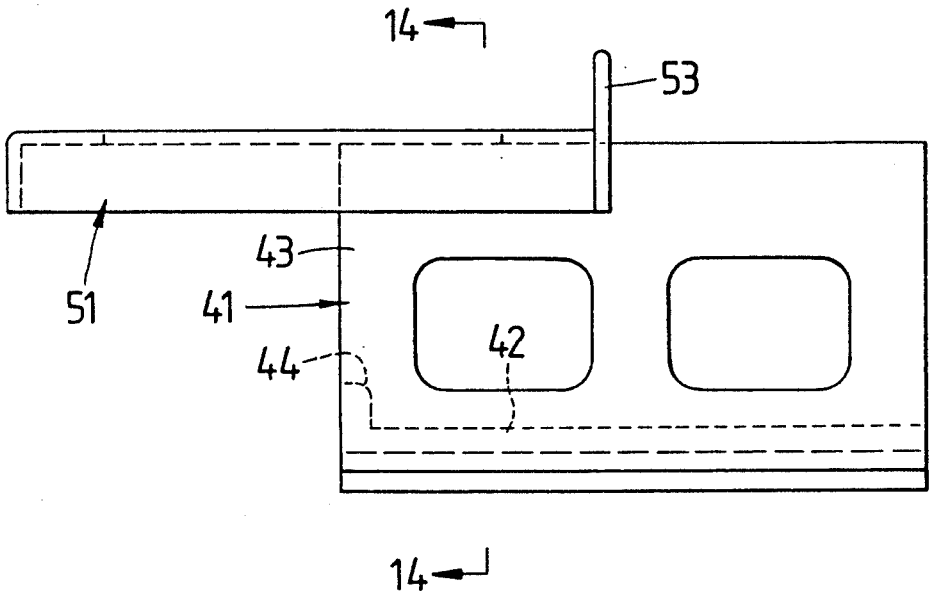
FIG. 12 is a side view of a third embodiment of the invention while in an open position.
Figure 13:
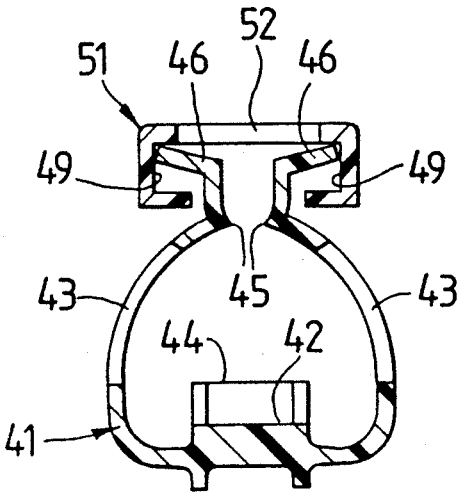
FIG. 13 is a sectional view taken along line 13—13 of FIG. 11.
Figure 14:
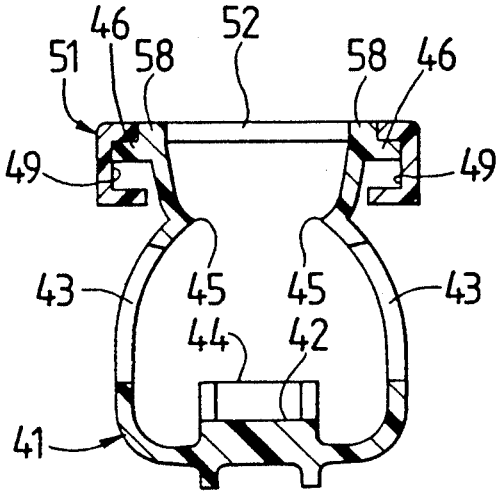
FIG. 14 is a sectional view taken along line 14—14 of FIG. 12.
Figure 17:
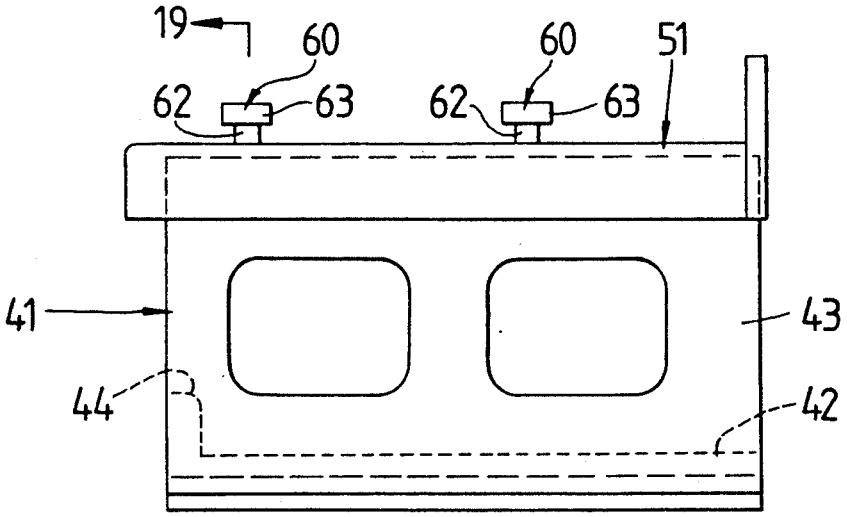
FIG. 17 is a side view of a fourth embodiment of the invention in a clasped position.
Figure 18:
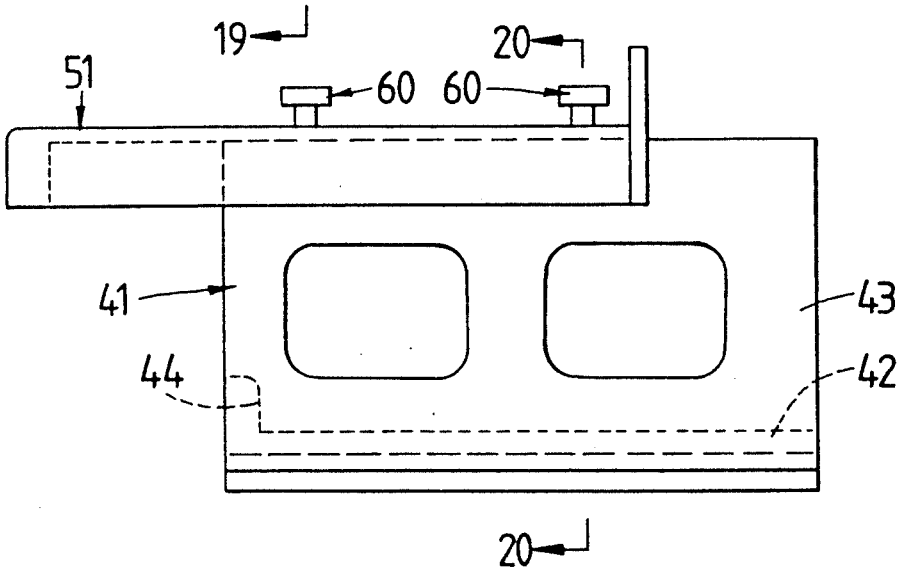
FIG. 18 is a side view of a fourth embodiment of the invention in an open position.
Figure 19:
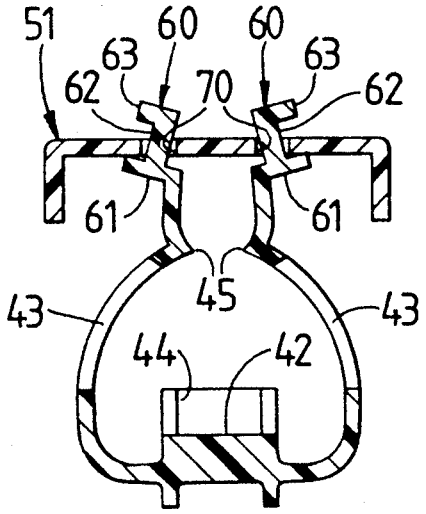
FIG. 19 is a sectional view taken along line 19—19 of FIG. 17.
Figure 20:
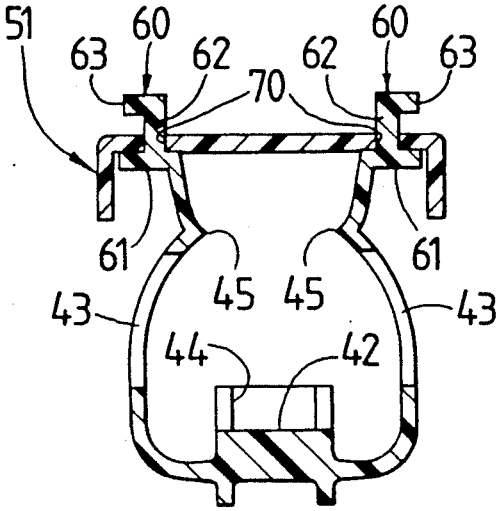
FIG. 20 is a sectional view taken along line 20—20 of FIG. 18.

The compression housing 51 surrounds, is connected to, and is linearly movable relative to the outer edges of the clasping wings 46, as shown in FIGS. 9 and 10. The compression housing 51 is preferably made from a strong molded plastic lacking the flexible characteristics of the receptacle's sidewalls 43.

The compression housing 51 includes two elongated compression tracks 49, which extend along the edge of the compression wings 46 when the receptacle 41 is inserted within the compression housing 51. The compression tracks 49 are shaped to mirror the edges of the clasping wings 46. The compression members are joined on one end by a closing brace 52 extending perpendicularly between the two compression tracks 49 at their closest juncture. The compression tracks 49 are joined at their end distal brace 52 by a C-shaped brace 53 which encloses the edge of the clasping wing 46 but allows relative linear movement of the compression housing 51 along the clasping wing 46. The compression tracks 49 extend from the inner face of the C-shaped brace 53 and mirror the shape and relative displacement of the marginal edges of the clasping wings 46, thus, the compression tracks 49 converge from the C-shaped brace 53 to brace 52. A stop plate 54 is located between the compression tracks 49 flush with the upper edge of the compression tracks 49 and extending from the C-shaped brace 53 and is defined by a pair of angled camming surfaces 56.

The compression housing 51 operates in an open position as viewed in FIG. 9 and a clasping position as viewed in FIG. 10. The compression housing 51 is placed in the open position by sliding the compression housing 51 toward the closed end of the receptacle 41 until the camming surfaces 56 come in contact with two trapezoidally shaped positioner pegs 58 located on the upper surface of the clasping wings 46. The compression housing 51 is placed in the clamping position by sliding the compression housing 51 toward the open end of the receptacle 41 until the closing brace 52 contacts the positioner pegs 58.

The third embodiment of the apparatus is operated by inserting a moistened toothbrush within the receptacle 41 in the open position, until the brush contacts the endstop 44. The compression housing 51 is then urged to the clamping position. As the compression housing 51 moves relative to the outer edge of the clasping wings 46, the clasping wings 46 are cammed inwardly by the compression tracks 49. As the clasping wings 46 are cammed inward, the sidewalls 43 are also pressed inwardly urging the clasping edges 45 located on the sidewalls 43 against the bristles of the brush, resulting in the deformation of the bristles as shown in FIG. 10 which corresponds to the deformation of the preceding embodiments as shown in FIG. 4 and FIG. 8.

A fourth embodiment of the invention is shown in FIGS. 17–22. The receptacle 41 is basically the same as shown in FIGS. 9–16 of the third embodiment. The clasping wings 46, as shown in FIG. 9, have been replaced with four clamping pins 60. As shown in FIGS. 17–20, the clamping pins 60 are attached to a pair of support plates 61 which are attached to the upper edges of the sidewalls 43, extending outward from the sidewall 43.

A clamping pin 60 includes a guide pin 62 and a securing flange 63. The guide pin 62 is attached to the upper surface of the support plate 61 and extends through guide slots 70 defined within the upper surface of a cam guide 64. The securing flange 63 is formed atop the guide pin 62 and extends perpendicular thereto.

Figure 21:
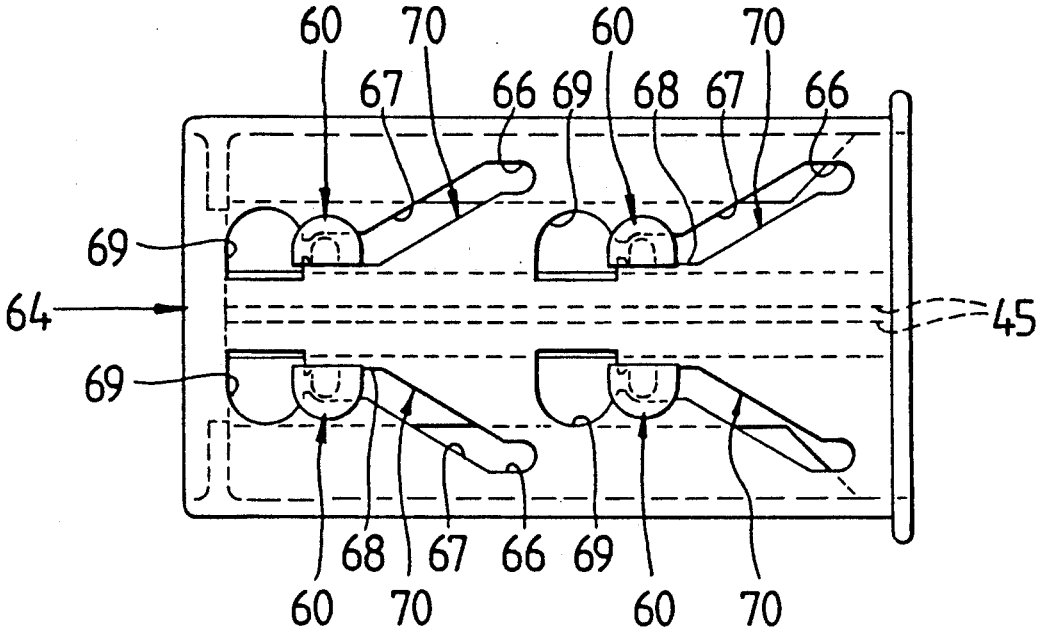
FIG. 21 is a plan view of a fourth embodiment of the invention in a clasped position.
Figure 22:
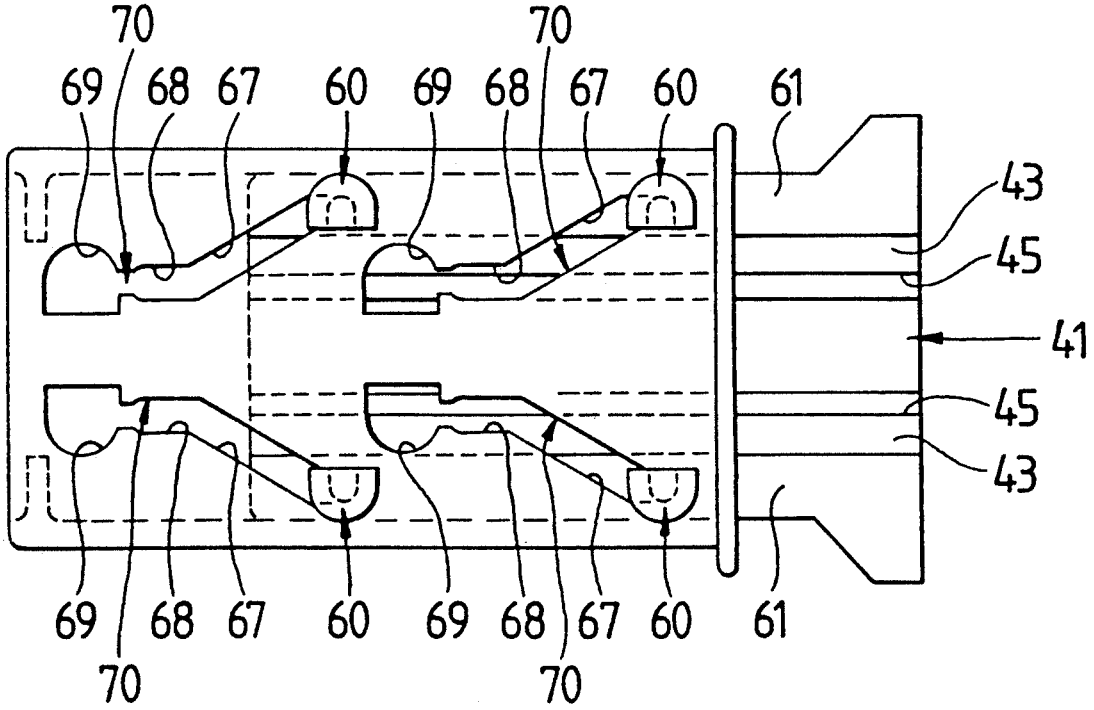
FIG. 22 is a plan view of a fourth embodiment of the invention in an open position.
Figure 23A:
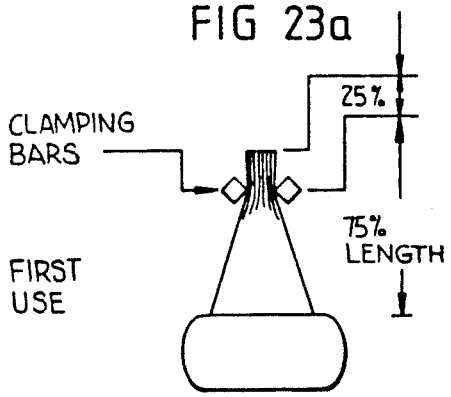
FIGS. 23*a*–25*c* are pictorial illustrations of a toothbrush showing the effects of using the invention on toothbrush bristles in relation to time.
Figure 23B:
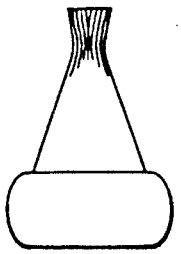
Figure 23C:
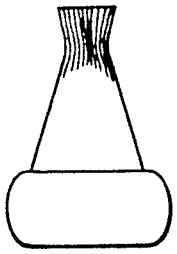
Figure 24A:
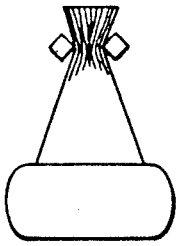
Figure 24B:
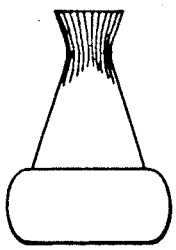
Figure 24C:
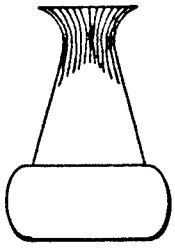
Figure 25A:
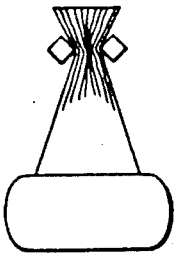
Figure 25B:
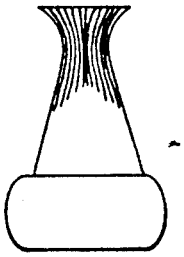
Figure 25C:
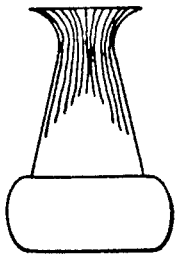
Figure 26:
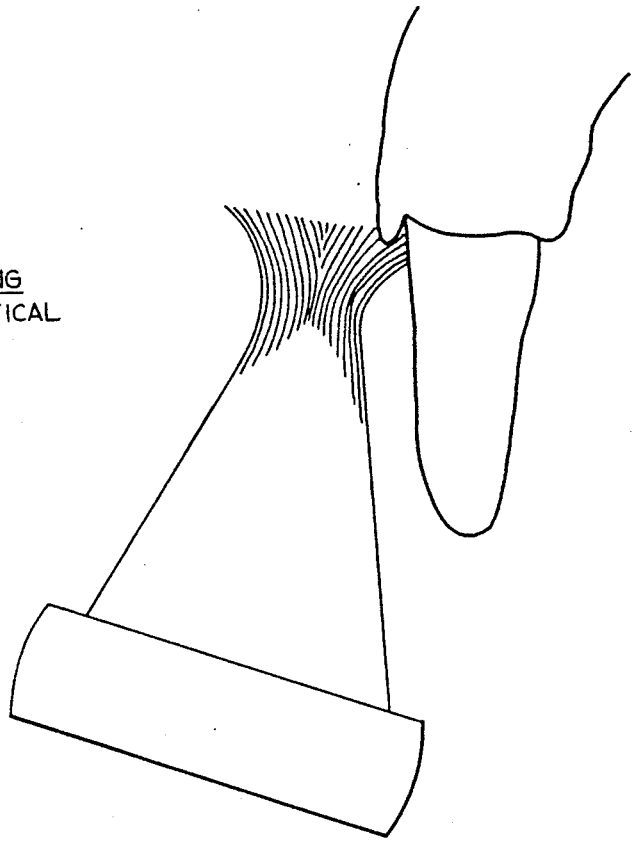
FIG. 26 is a pictorial illustration of a toothbrush engaging the sulcus region of a tooth being positioned vertically in relation to the tooth, illustrating an edge brushing technique.
Figure 27:
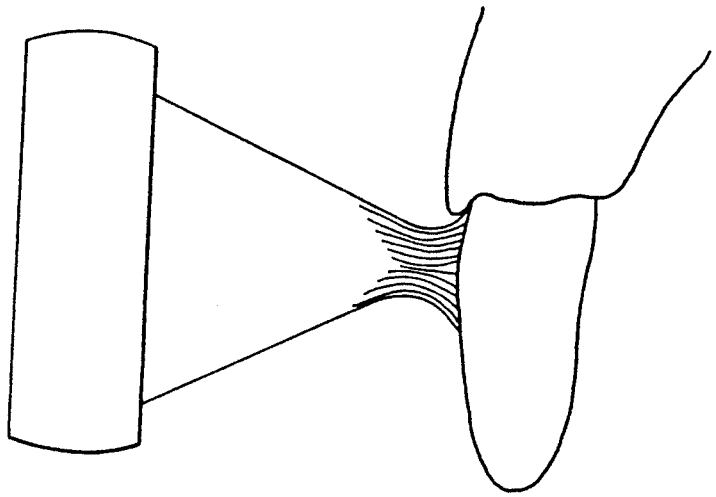
FIG. 27 is a pictorial illustration of a toothbrush engaging the sulcus region of a tooth positioned approximately 90 degrees from the position depicted in FIG. 26, illustrating a flare brushing technique.

Two clamping pins 60 are positioned on each support plate 61 thereby slidably connecting the cam guide 64 to the receptacle 41. Each guide slot 70 contains an entry portion 66, a compressing portion 67 and a retaining portion 68. As shown in FIG. 21, the entry portions 66 of the guide slots 67 are spaced both laterally and linearly along the upper surface of the cam guide 64 such that the spacing between the clasping pins 60 corresponds to an open position of the receptacle 41. As shown in FIG. 22, the compressing portions 67 converge toward the longitudinal axis of the cam guide 64 creating camming surfaces which urge the clasping pins inwardly as the receptacle 41 is inserted within the cam guide 64.

The retaining portions 68 are in communication with and extend rearwardly from the compressing portions 67. The retaining portions 68 extend parallel to the longitudinal axis of the camming housing 64. Each retaining portion 68 extends an equal, predetermined distance from the compressing portion 67 ending in an insert portal 69. The insert portal 69 is an opening defined with the cam guide and being of similar shape and size as the outer perimeter of the securing flange 63.

When the apparatus is in an open position, as shown in FIG. 22, clamping pins 60 are located within the entry portions 66 of the guide slots 70. The sidewalls 43 being connected to the clamping pins 60 are spaced apart a distance which permits a toothbrush to be freely inserted into the receptacle 41.

Once the toothbrush is inserted , the cam guide 64 is moved forward and above the receptacle 41. This action causes the clamping pins 60 to move within the compressing slots 67. The clamping pins 60 are forced laterally inwardly by the camming surface of the compressing slots 67, resulting in a laterally inward compression of the sidewalls 43 and the clasping edges 45. The deformation effect upon the brush bristles by this compression is the same as discussed in the third embodiment. A continued forward movement of the cam guide 64 forces the clamping pins 60 into the retaining position 68, thereby placing the apparatus in the clamping position. The apparatus should be left in this position to maximize proper deformation of the brush bristles.

Further forward motion of the cam guide 64 forces the clamping pins 60 into the insert portal 69. Manual manipulation of the clasping pins inward and downward will allow the securing flanges 63 to pass through the insert portal 69, thereby disengaging the receptacle 41 from the camming housing 64. This manual manipulation aids only in the assembly and disassembly of the apparatus and does not in any way further the application of the apparatus in molding the bristle structure of a toothbrush.

With proper utilization of these preferred embodiments, the bristles are thus formed into a well-defined upper and lower wedge having their apexes joined along the compression line. The bristles eventually take a permanent set and are deformed substantially in a controlled and desirable manner. In as much as the flare of the wedge forces the lower bristles together, the uncontrolled splaying that occurs in the normal brush does not occur here. Thus, the present invention utilizes and enhances the natural wear characteristics of the bristles to form the cohesive mass of fibers which enable the user to properly address the sulcus region of the gum line.

By placing the wet brush in the receptacle and closing the mechanism after each use the bristles will be formed and maintained in their proper orientation just as described in my application Ser. No. 199,373. While the end result of my apparatus and its predecessor are the same, it will be appreciated that the novel structure described herein is far more amenable to widespread use and the promotion of proper dental hygiene.

While I have shown my invention in various forms, it will be obvious to those skilled in the art that it is not so limited but is susceptible of various changes and modifications without departing from the spirit thereof.

What I claim is:

1. Apparatus for training the bristles of a toothbrush, having an elongated handle portion with a plurality of bristles at one end thereof, into an upper wedge shaped portion and a lower wedge shaped portion with each portion diverging laterally from a line at a preselected height on said bristles, comprising:

(a) a receptacle having a bottom connected to a first and second spaced apart sidewall, for receiving the one end of the handle portion and the plurality of bristles thereon, longitudinally therewithin;

(b) means for clamping said bristles along a predetermined line mounted within said receptacle and extending longitudinally therewithin in spaced apart relation for receiving said plurality of bristles therebetween, wherein said clamping means comprises a first and second clamping edge, being integrally connected to and a part of said receptacle and extending longitudinally along said respective first and second sidewalls in spaced relation for receiving said plurality of bristles therebetween; and (c) means for selectively urging said clamping means together whereby a clamping force is applied to said plurality of bristles along a line defined by said clamping means with said urging means having a pair of clasping wings integral with said sidewalls, and extending outwardly from a space formed intermediate said sidewalls with a pair of marginal edges formed by said clasping wings tapering inwardly toward said space formed intermediate said sidewalls to form camming surfaces that converge from an entrance end of said receptacle to a closed end of said receptacle, and said urging means further having means for compressing said clasping wings inwardly toward said space a predetermined distance to urge said first and second clamping edges against said plurality of bristles, wherein said compressing means is comprised of a pair of elongated cam tracks, connected on one end thereof by a closing brace which extends transversely therebetween and connected on the opposite end by a C-shaped brace, extending therebetween, which allows said clasping wings to be inserted within said cam tracks and wherein said compressing means, when urged along said clasping wings, guides said tapered clasping wings inwardly toward said space.

2. Apparatus for training the bristles of a toothbrush, having an elongated handle portion with a plurality of bristles at one end thereof, into an upper wedge shaped portion and a lower wedge shaped portion with each portion diverging laterally from a line at a preselected height on said bristles, comprising:

(a) a receptacle having a bottom connected to a first and second spaced apart sidewall, for receiving the one end of the handle portion and the plurality of bristles thereon, longitudinally therewithin;

(b) means for clamping said bristles along a predetermined line mounted within said receptacle and extending longitudinally therewithin in spaced apart relation for receiving said plurality of bristles therebetween, wherein said clamping means comprises a first and second clamping edge, being integrally connected to and a part of said receptacle and extending longitudinally along said respective first and second sidewalls in spaced relation for receiving said plurality of bristles therebetween; and (c) means for selectively urging said clamping means together whereby a clamping force is applied to said plurality of bristles along a line defined by said clamping means with said urging means having a pair of clasping wings integral with said sidewalls, and extending outwardly from a space formed intermediate said sidewalls with a pair of marginal edges formed by said clasping wings tapering inwardly toward said space formed intermediate said sidewalls to form camming surfaces that converge from an entrance end of said receptacle to a closed end of said receptacle, and said urging means further having means for compressing said clasping wings inwardly toward said space a predetermined distance to urge said first and second clamping edges against said plurality of bristles wherein said compressing means is comprised of a pair of elongated cam tracks, connected on one end thereof by a closing brace which extends transversely therebetween and connected on the opposite end by a C-shaped brace, extending transversely, which allows said clasping wings to be inserted within said cam tracks, wherein said cam tracks converge from said entrance brace toward said closing brace in equal proportion to convergence of said marginal edges of said clasping wings and guide said clasping wings inserted therein inwardly toward said space.

3. Apparatus as described in claim 2 further comprising as top plate, extending transversely between said cam tracks, defined by a pair of angled camming surfaces located on an edge of said stop plate which faces toward said closing brace and contact a pair of locator pins formed on said clasping wings when said apparatus is in an open position, said locator pins contacting said closing brace when said apparatus is in a closed position.

* * * * *